US005875499A

United States Patent [19]

Hoffman et al.

[11] Patent Number: 5,875,499

[45] Date of Patent: Mar. 2, 1999

[54] RECREATIONAL VEHICLE TOILET WITH FLUSH NOZZLE DEFLECTOR SHIELD

[75] Inventors: John A. Hoffman, Brighton; Kenneth J. Hall, Ann Arbor; John R. Selina, Brighton; John M. Antos, Ann Arbor, all of Mich.

[73] Assignee: Thetford Corporation, Ann Arbor, Mich.

[21] Appl. No.: 12,493

[22] Filed: Jan. 23, 1998

[51] Int. Cl.[6] ..... E03D 11/08

[52] U.S. Cl. ..... 4/420; 4/249; 4/423; 4/438

[58] Field of Search ..... 4/249, 321, 420, 4/421, 422, 423, 434, 435, 438, 440, 441, 442

[56] References Cited

U.S. PATENT DOCUMENTS 3,860,973 1/1975 Uyeda et al. ..... 4/435 X
4,710,988 12/1987 Stewart ..... 4/438
5,010,602 4/1991 Sargent et al. ..... 4/321 X
5,060,320 10/1991 Sargent et al. ..... 4/438
5,142,708 9/1992 Johnson et al. ..... 4/249

*Primary Examiner*—Robert M. Fetsuga
*Attorney, Agent, or Firm*—Harness, Dickey & Pierce, P.L.C.

[57] ABSTRACT

The toilet with a deflector shield covering the flush nozzle to deflect a portion of the flush water. The deflected water flows downward to wet the bowl in the area beneath the flush water nozzle. The undeflected water flows onto a ledge at the upper end of the bowl and flows around the bowl where it gradually falls off the ledge and wets the remaining portion of the bowl. Both a foot pedal and a hand lever are provided for flushing the toilet and a cable is used to couple the foot pedal to the hand lever. The hand lever is operably connected to the flush water valve as well as the bowl discharge opening closure member to open both for flushing of the toilet.

21 Claims, 5 Drawing Sheets

RECREATIONAL VEHICLE TOILET WITH FLUSH NOZZLE DEFLECTOR SHIELD

BACKGROUND AND SUMMARY OF THE INVENTION

The present invention relates to a toilet and in particular to a toilet for use in a recreational vehicle or as a portable toilet having a limited water supply necessitating that the water be used efficiently in wetting the toilet bowl during flushing.

In recreational vehicles and portable toilets, relatively small quantities of water are available for use in flushing the toilet. Accordingly it is necessary that the water be used in a highly efficient manner in cleansing the bowl. It has been found that discharging flush water onto a ledge at the upper end of the bowl and allowing the water to flow around the bowl on the ledge is an efficient way to cleanse the bowl. However, it is often difficult to achieve proper wetting of the entire bowl surface, especially the area directly below the flush water nozzle. If the water is discharged onto the ledge with sufficient velocity to flow around the bowl and fall off the ledge to wet the area below the nozzle, an insufficient amount of water will fall off the ledge at the beginning of the water flow path to achieve a complete wetting of the bowl. Likewise, if the water is discharged at a low enough velocity that it immediately begins to fall off the ledge, the water does not have enough velocity to travel around the bowl and wet the area immediately below the flush nozzle.

Accordingly, it is an object of the present invention to provide a toilet bowl with a flush nozzle that overcomes the above difficulties and achieves a thorough wetting of the bowl surface.

To accomplish this objective, the toilet of the present invention is equipped with a shield that covers the flush water nozzle and has an end wall that deflects some of the water from its path on the ledge. The shield also has a sidewall which is spaced inwardly of the bowl at a position adjacent the ledge which causes the deflected water to run downward into the bowl, wetting the area beneath the nozzle. The end wall of the shield has a lower end that is spaced above the ledge, forming an open passage below the end wall allowing some of the water from the nozzle to flow onto the ledge. As the water moves on the ledge, it looses its momentum, and as the velocity of the water decreases, the centrifugal force of the water holding it onto the ledge decreases, whereby the water gradually falls off the ledge, around the periphery of the bowl to wet the bowl surface. The water falling off the ledge, combined with the deflected water flowing downward from the shield, substantially wets the entire bowl surface.

The bowl has a bottom discharge opening through which water and waste is flushed from the bowl. A movable closure member is provided for opening and closing the bowl discharge opening. A foot pedal is provided for operation of the closure member to move the closure member to an open position and also to open a flush water supply valve to provide water to the flush nozzle. The foot pedal is coupled by a pull-cable to the closure member and to the flush water valve, both of which are mounted to the toilet housing. To enable flushing of the toilet in the event of a failure of the pull-cable, a rotatable hand lever is provided for flushing the toilet by hand. The pull-cable has one end attached to the foot pedal and the other end attached to the hand lever for rotating the hand lever. The hand lever is in turn coupled to the closure member and the flush water valve to open the bowl discharge opening and to open the flush water valve.

The flush water valve is mounted to the toilet behind the bowl, at the upper end thereof. A removable cover is provided to conceal the valve from view. The cover is preferably attached by snap fasteners. The valve is mounted so that it can be easily removed from the toilet, from above, if necessary for replacement or servicing of the valve. This avoids a complicated removal of the entire toilet from where it is installed and resealing of the toilet for servicing the valve. In the preferred embodiment, the flush water valve is integrally formed with a vacuum breaker.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
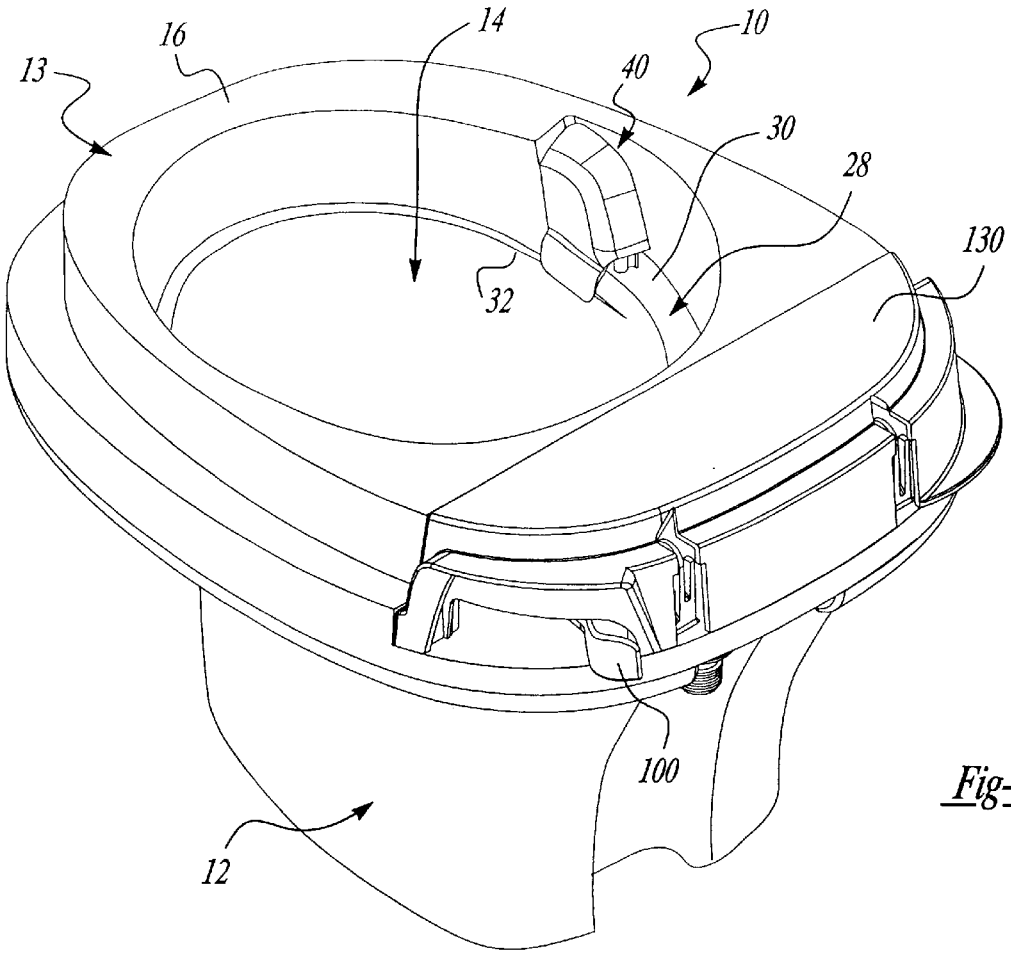
FIG. 1 is a perspective view of the toilet of the present invention showing the bowl and flush nozzle deflector shield.
Figure 2:
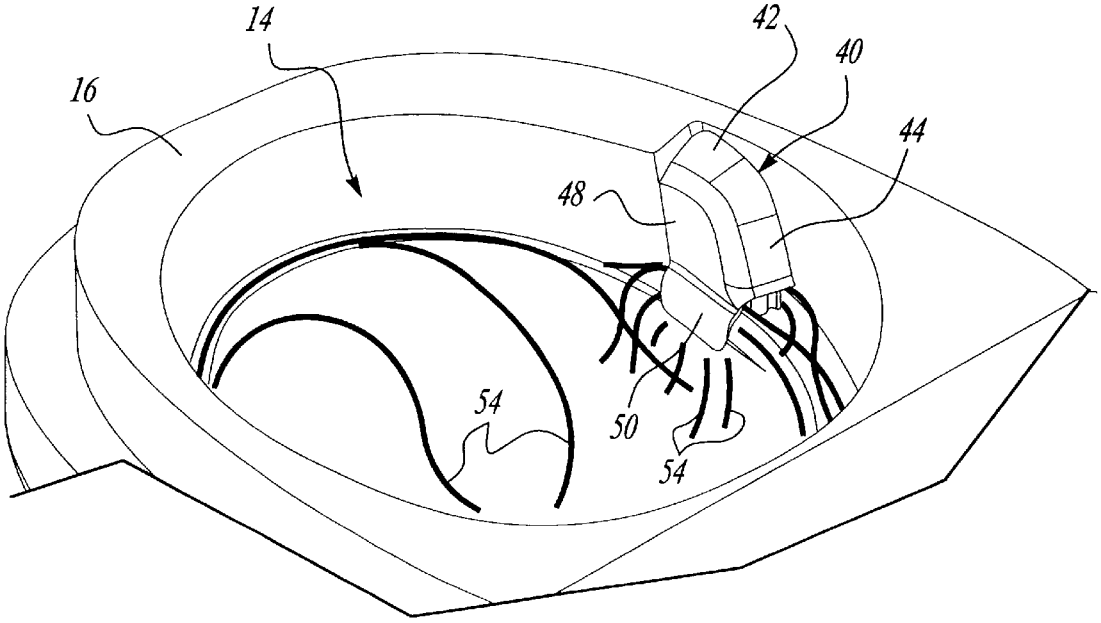
FIG. 2 is an enlarged perspective view of the bowl showing water flowing from the flush nozzle and into the bowl.

The toilet of the present invention is shown in the figures and designated generally at 10. The toilet 10 includes a housing or pedestal 12 which supports an upper portion 13. The upper portion includes a bowl 14 supported at an elevated position. The toilet further includes a rotatable toilet seat and lid in a conventional manner, which are not shown. The bowl 14 has an open upper end 16 forming a rim and slopes downward to a lower end 18 leading to a discharge opening 20. A closure member 22 is provided at the discharge opening 20 to close the discharge opening. A seal, not shown, is provided in a conventional manner to prevent liquid and solid waste from draining from the bowl when the closure member 22 is in a closed position. The closure member 22 is attached to a pivot rod 24 that is pivotally mounted to the upper portion 13 for rotation about a generally upright axis defined by the pivot rod 24. Upon rotation of the rod 24, the closure member 22 is moved between the closed position in which the discharged opening 20 is closed and an open position allowing waste to flow from the bowl through the discharge opening 20.

Figure 8:
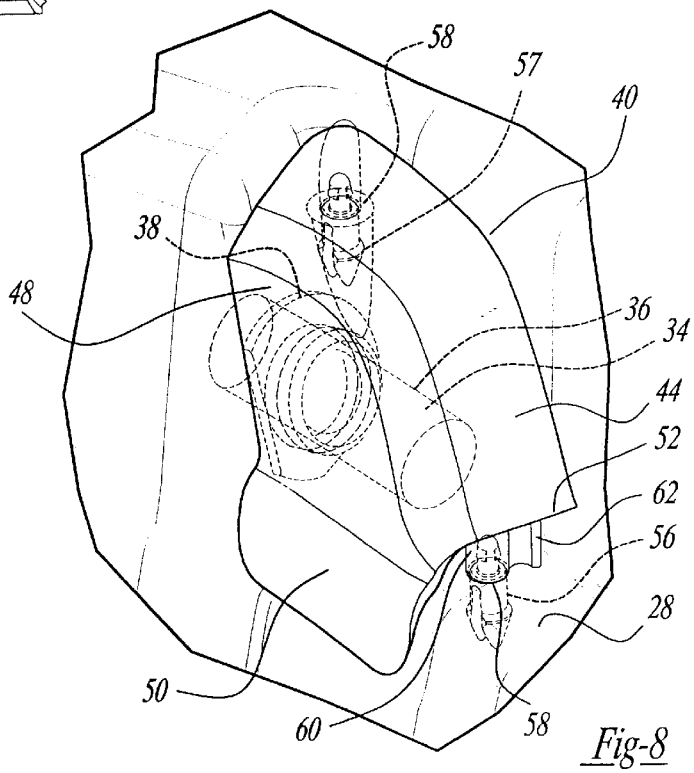
FIG. 8 is an enlarged perspective view of the flush nozzle and deflector shield.
Figure 10:
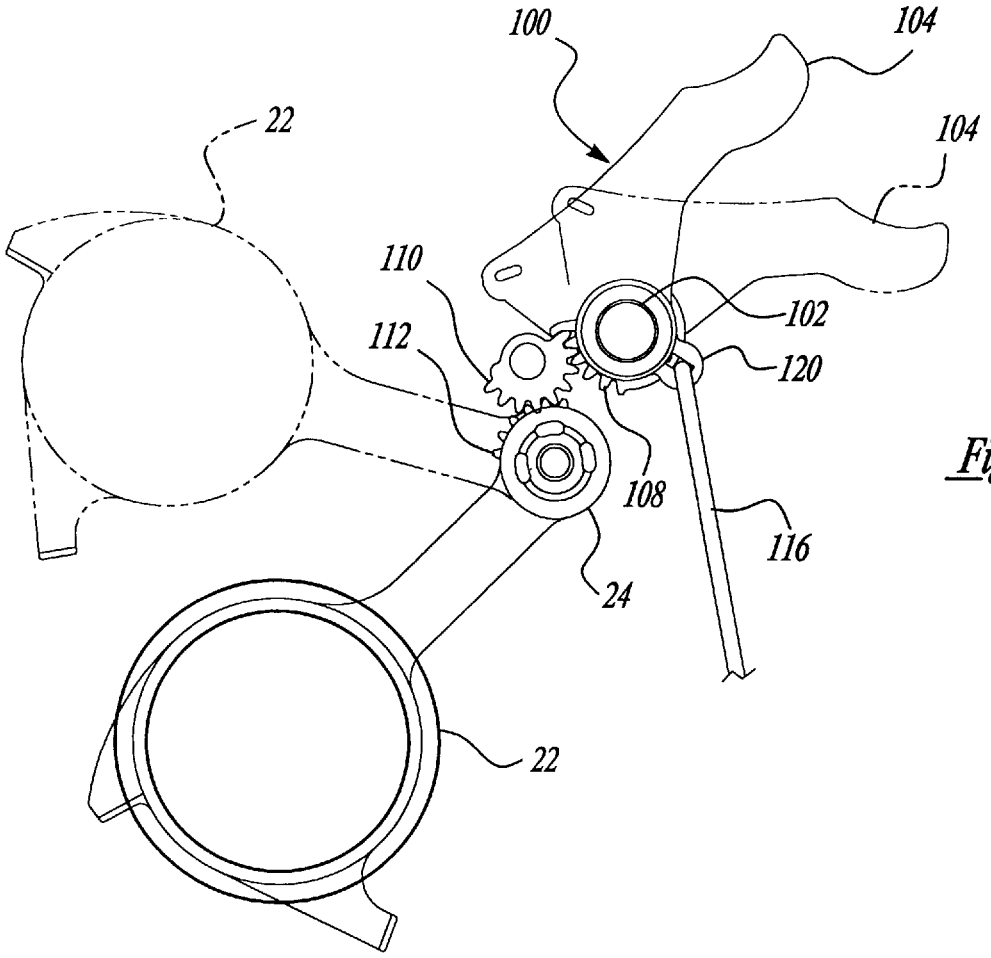
FIG. 10 is a top plan view of the flush hand lever and gear drive coupling to the bowl discharge opening closure member.

Near the upper end of the bowl, the bowl surface is formed with a ledge 28 which begins on the right side of the toilet and extends around a toilet while gradually tapering in width and sloping downward. The ledge terminates at the right side of the toilet at an end 32 which is slightly below the beginning 30 of the ledge. A flush water nozzle is provided at the beginning 30 of the ledge for discharging flush water onto the ledge and into the bowl for cleaning the bowl surface. The nozzle 30 is formed by the end 34 of a tube 36 that extends through an opening into the bowl and is sealed by a grommet 38 (FIG. 8). Water is discharged from the tube 36 onto the ledge and flows around the bowl on the ledge. The water gradually falls off the ledge and over the bowl surface to the discharge opening 20.

To ensure complete wetting of the bowl surface, a deflector shield 40 is placed over the tube 36 and deflects a portion of the water downward into the bowl in the region beneath the tube end 34. The deflector shield 40 has a top wall 42 above the tube 36, an end wall 44 that is spaced from the tube end 34 and a sidewall 48 that is spaced inward into the bowl from the tube 36. The lower end portion 50 of the sidewall 48 is offset relative to the remaining portion of the sidewall inwardly and downwardly into the bowl, below the ledge 28. The bottom edge 52 of the end wall 44 is spaced above the ledge 30, forming an opening between the end wall and the ledge. This allows a portion of the water from the tube 36 to flow beneath the end wall and onto the ledge where it flows around the bowl as described above. A portion of the water will splatter against the end wall 44 and ultimately flow downward between the sidewall 48 and the bowl where it fans out while wetting the bowl as shown by the lines 54 in FIG. 3.

The deflector shield 40 is preferably a single piece plastic molded part. The shield is formed with a pair of mounting bosses having bores which receive plastic snap fingers 56 and 57 shown in FIG. 8. The snap fingers 56 and 57 are inserted into apertures 58 in the bowl to secure the deflector shield to the bowl. Snap finger 56 is inserted into a bore formed in a boss 60 that extends downwardly from the end wall 44 below its bottom edge 52 into the flow path for the water directed onto the ledge. The boss 60 divides the water so a portion of it will pass radially outward around the boss while the remainder of the water passes radially inward of the boss. This divided flow path improves the bowl wetting as the different water streams fall off the ledge at different locations around the bowl periphery.

Figure 3:
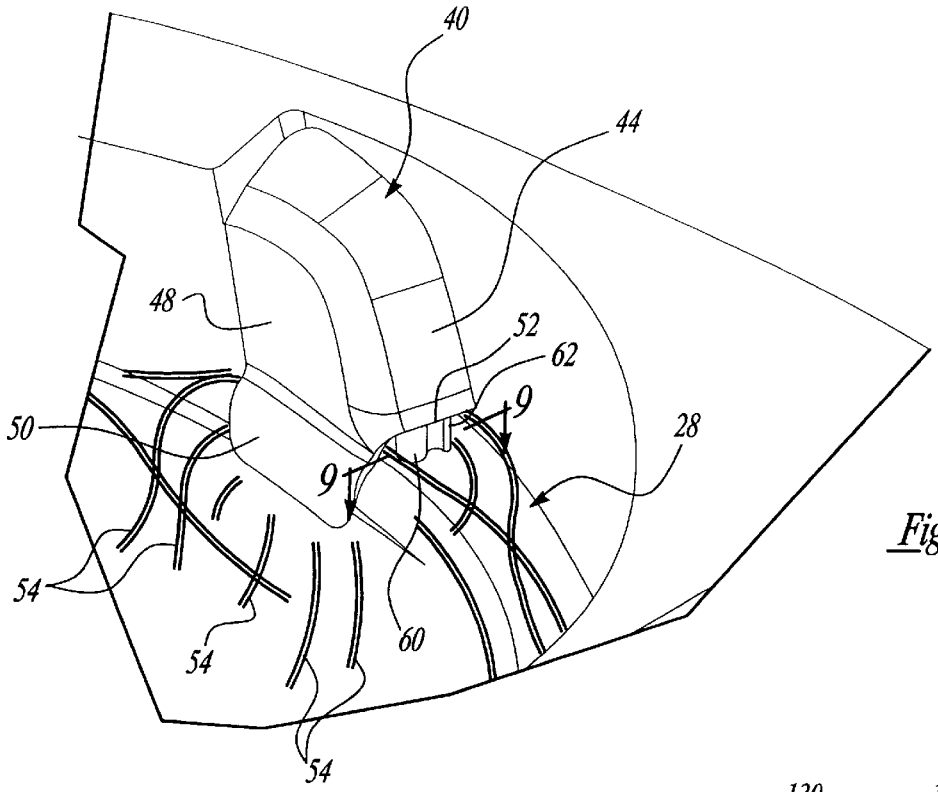
FIG. 3 is an enlarged perspective view of the flush nozzle and deflector shield with water flowing therefrom.
Figure 4:
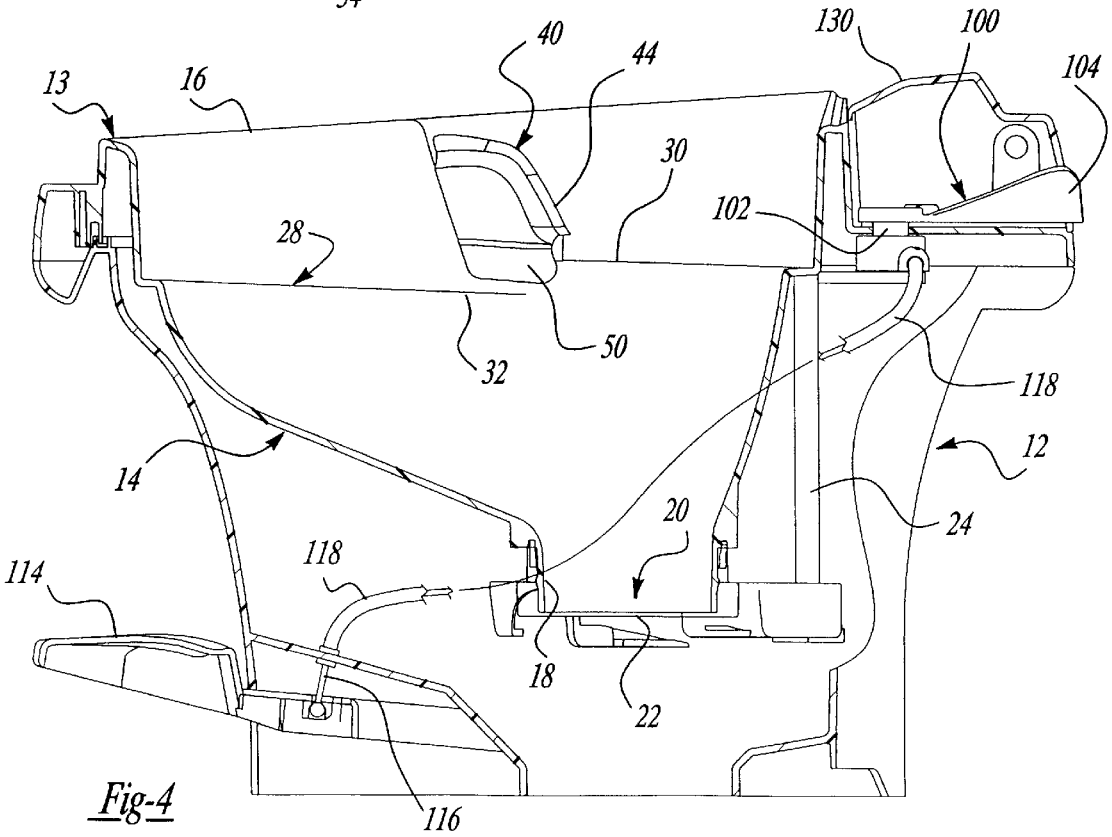
FIG. 4 is a side sectional view of the bowl and housing.
Figure 9:
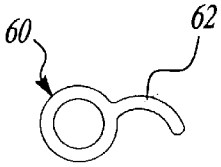
FIG. 9 is a sectional view of a deflector shield mounting boss as seen from substantially the line 9—9 of FIG. 3.

In a preferred embodiment, the boss 60 includes an extending diverter flange 62 best shown in FIGS. 3 and 9. This diverter flange serves to further separate the water flow paths.

Figure 5:
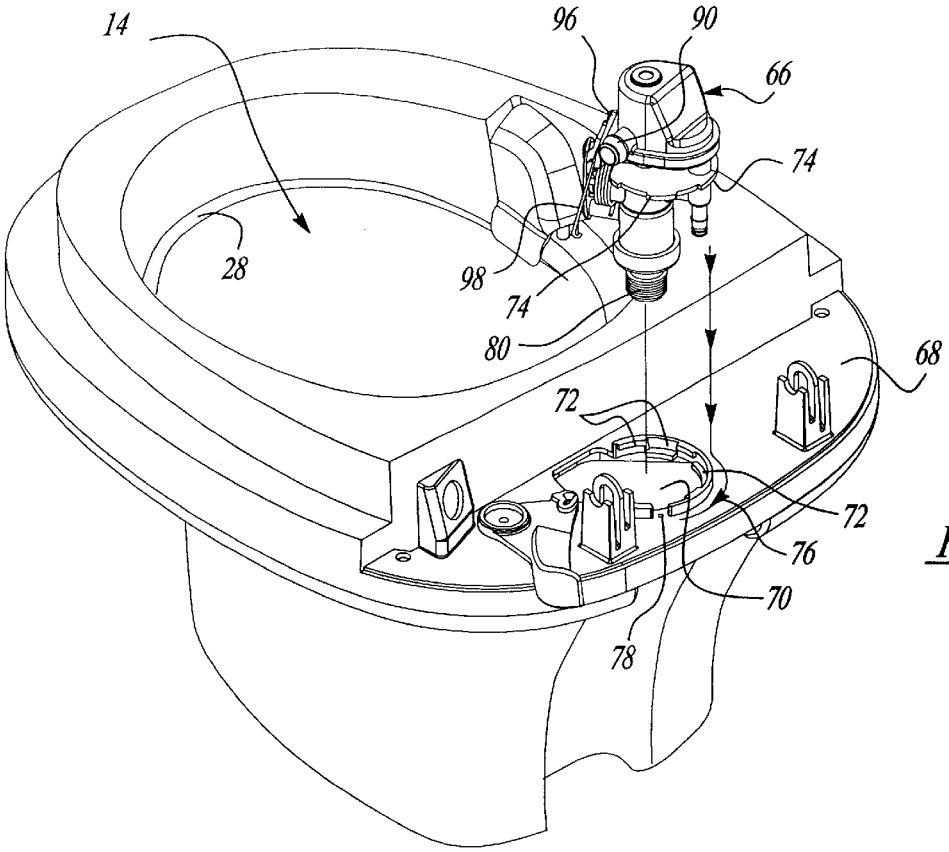
FIG. 5 is a rear perspective view of the toilet showing the flush water valve removed.

The tube 36 is attached at its other end to a flush water valve 66 which is mounted to a horizontal support platform 68 at the back of the bowl 14, near the upper end thereof. The valve 66 is operable to supply flush water to the tube 36 for delivery to the bowl ledge. The valve 66 is shown in its installed position in FIG. 6 while it is shown in a disassembled position in FIG. 5. The valve extends through an opening 70 in the platform 68. The opening 70 has a plurality of ribs 72 about its periphery that engage with tabs 74 on the valve to enable the valve to twist lock into place as shown by the arrow 76. This enables quick mounting of the valve to the toilet for both initial assembly and also for servicing if necessary. A screw is inserted into the hole 78 adjacent to the opening 70 once the valve has been twisted into place. The screw prevents rotation of the valve from its locked position.

A water supply pipe (not shown) is threadably connected to the valve inlet 80 which is disposed beneath the platform 68 and behind the toilet housing. The connection of the supply pipe to the valve can be accessed by reaching behind an installed toilet. Since the valve is removed by lifting the valve upward from the platform 68, the toilet is easily serviced. The toilet does not have to be removed from its installed position to access the valve. Thus the toilet seals do not have to be replaced as a part of servicing the water valve.

Figure 6:
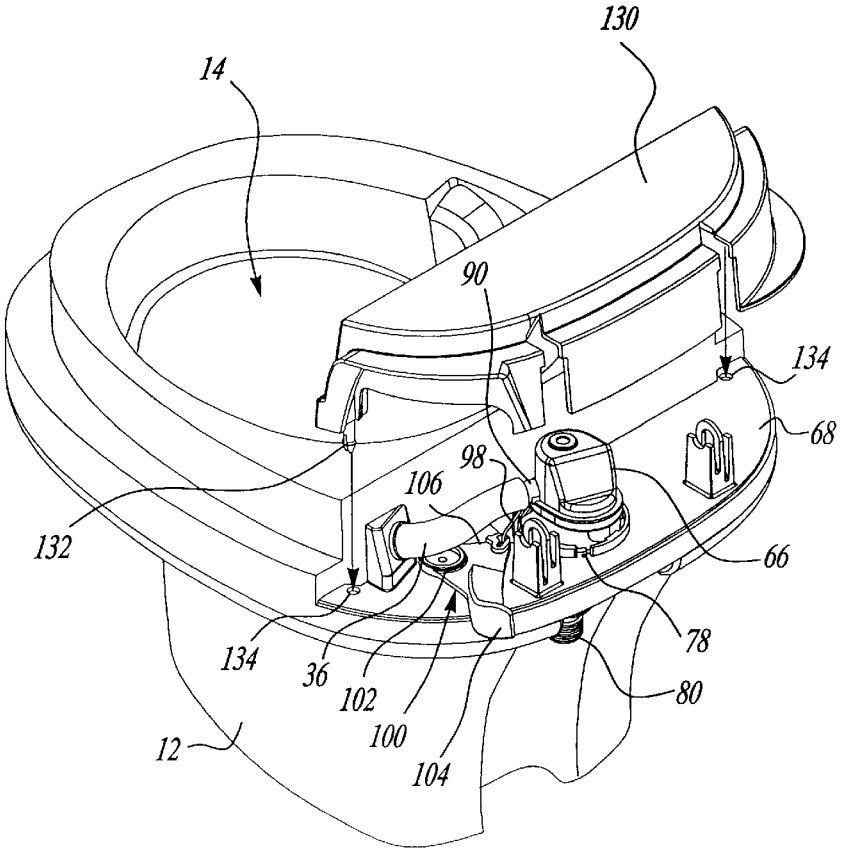
FIG. 6 is a perspective view similar to FIG. 5 showing the flush water valve installed and the valve cover in a removed position.
Figure 7:
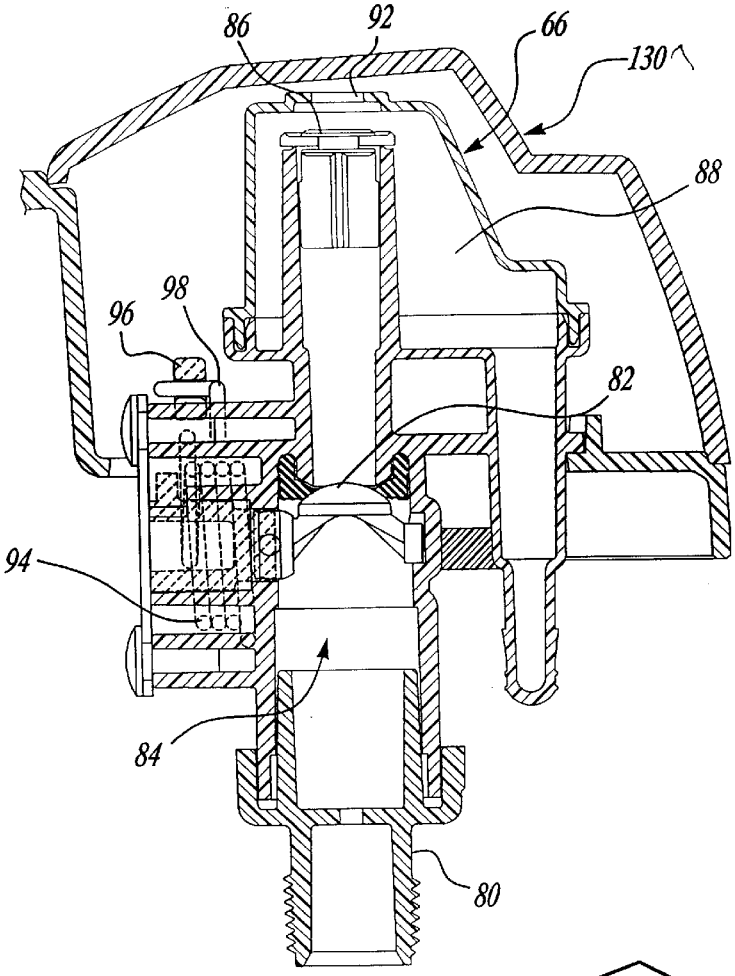
FIG. 7 is a sectional view of the flush water valve.

The valve 66 is shown in cross section in FIG. 7. A spherical valve ball 82 is placed within the water conduit 84 and stops water flow in a closed position. Water flows upward through a conduit 84 past the ball 82 when the ball is rotated to an open position. At the upper end of the conduit 84, a check valve 86 is provided. The water pressure will lift the check valve off the upper end of the conduit 84, allowing the water to flow into the chamber 88. Chamber 88 is coupled to the outlet fitting 90, shown in FIGS. 5 and 6. The chamber 88 has a vent opening 92 directly above the check valve 86. When the check valve is lifted, it seals the vent opening 92 to prevent water leaking from the chamber 88. When the ball 82 is closed, the check valve 86 will lower opening the vent 92 and allowing water to drain through the tube 36. The check valve thus serves as a vacuum breaker. In addition, the valve 86 serves as a back flow preventer by preventing water from flowing back into the conduit 84 from the chamber 88.

A torsion spring 94 is coupled to the ball 82 to bias the ball 82 to its closed position. A crank arm 96 is coupled to the ball 82 from the valve and is coupled by a link 98 to a hand lever 100, attached to the support platform 68. The hand lever 100 is rotatably mounted to the platform at the pivot 102 and has an extending grip portion 104. The link 98 is coupled to the hand lever at the boss 106.

Beneath the platform 68, the hand lever has a gear sector 108 that is concentric with the pivot 102. The hand lever gear sector engages the teeth of an idler gear sector 110 also pivotally mounted to the underside of platform 68. The idler gear sector engages a gear sector 112 of the pivot rod 24. Thus, upon rotation of the hand lever 100, the idler gear sector and the pivot rod 24 both rotate about their respective axes. Rotation of the pivot rod causes the closure member 22 to open the discharge opening 20 at the bottom of bowl 14. Rotation of the hand lever also opens the flush water valve 66, resulting in flush water being introduced into the bowl to rinse the bowl surface.

While the hand lever 100 can be operated directly by grasping the grip 104 and rotating the lever, foot pedal operation of the toilet is also provided. A foot pedal 114 is pivotally mounted to the housing and extends forward from the housing for operation by a person utilizing the toilet. A flexible wire 116 has one end coupled to the pivot lever and extends through a cable sheath or conduit 118 attached to the toilet housing 12 and upper portion 13. The other end of the wire 116 is attached to the boss 120 of the hand lever 100. Depressing the pedal 114 pulls on the wire 116 which in turn rotates the hand lever 100 to open the flush water valve and the bowl discharge opening. The provision of both the foot pedal and hand lever operation enables the user to select the manner in which the toilet is operated. In addition, the hand lever provides a means to operate the toilet should the wire 116 malfunction or break, preventing operation of the toilet by use of the foot pedal 114.

With reference to FIGS. 1 and 6, the toilet further includes a cover 130 which is mounted to the platform 68 and conceals the flush valve 66. The cover 130 is provided with snap fastener fingers 132 which are inserted into apertures 134 in the housing. These snap fingers enable the cover to be easily installed and removed without the use of tools. The cover is removable to gain access to the valve 66 should there be a need for servicing of the valve.

The upper portion 13 is a single molded component which forms the bowl 14, the rim at the upper end 16 of the bowl and the support platform 68. The working mechanisms of the toilet are all mounted to the upper portion. These include the flush valve 66, the hand lever 100, the closure member 22 and the pivot rod 24. Only the pedal 114 and one end of the control cable are attached to the housing 12. By mounting the working components all on the single piece upper portion, assembly and service of the toilet are simplified. The working components can all be removed with the removal of the upper portion. The cable connection between the housing 12 and upper portion allows for relative movement between these parts and can be disconnected fairly easily. It should also be noted that the water supply is coupled directly to the valve inlet 80. The water supply line does not connect or couple to the housing 12.

The toilet of the present invention has an improved flush by virtue of the deflector shield covering the flush nozzle to deflect a portion of the flush water. The deflected water flows downward to wet the bowl in the area beneath the flush water nozzle. The remaining water flows onto a ledge at the upper end of the bowl and flows around the bowl where it gradually falls off the ledge and wets the remaining portions of the bowl.

A foot pedal and a hand lever are provided for flushing the toilet. A cable couples the foot pedal to the hand lever. The hand lever is in turn operably connected to the flush water valve and the bowl discharge opening closure member to open both for flushing of the toilet.

It is to be understood that the invention is not limited to the exact construction illustrated and described above, but that various changes and modifications may be made without departing from the spirit and scope of the invention as defined in the following claims.

We claim:

1. A toilet comprising:

an upright bowl having an upper end and a bottom discharge opening with a generally horizontal ledge adjacent the upper end thereof;

conduit means terminating in a discharge nozzle for discharging flush water in a generally horizontal path onto the ledge so that the flush water will travel around the periphery of the bowl on the ledge; and a deflector shield spaced relative to the nozzle and in the path of water discharged from the nozzle, the shield deflecting a portion of the water from the path to cause the water to flow downward into the bowl beneath the nozzle while undeflected water is directed onto the ledge and as the water moving on the ledge loses its momentum, and as the velocity of the water decreases, the centrifugal force of the water that is holding it on the ledge decreases and the water gradually runs off the ledge around the periphery of the bowl to wet the bowl.

2. The toilet of claim 1 wherein the shield has an inclined end wall opposite the nozzle and spaced therefrom against which water from the nozzle splatters to deflect water from the path and cause the water to run down into the bowl, the end wall having a lower end that is spaced above the ledge forming an open passage below the end wall for allowing water in the path to flow onto the ledge, the shield also having a side wall which is spaced inwardly of the bowl at a position adjacent the ledge allowing some water from the nozzle to run down into the bowl.

3. The toilet of claim 2 wherein the side wall of the shield has a lower end that is spaced inward of the ledge and extends downward into the bowl below the ledge.

4. The toilet of claim 1 wherein the shield includes snap fasteners to attach the shield to the bowl whereby the shield can be readily removed for cleaning of the bowl.

5. The toilet of claim 1 wherein the shield has a mounting boss extending downward from the end wall below the lower end thereof into the path of water discharged onto the ledge to divide the water into separate streams of water flowing on the ledge.

6. The toilet of claim 5 wherein the mounting boss is generally cylindrical with a diverter flange extending laterally therefrom into the water path.

7. The toilet of claim 1 further comprising:

a generally horizontal support platform behind the bowl and integrally formed therewith as a single piece toilet upper portion; and a flush water supply valve operatively associated with the conduit means for controlling the supply of flush water to the conduit means, the valve including a valve member movable between open and closed positions to turn on and off the supply of water to the conduit means, the valve being mounted to the support platform and removable from the platform from above.

8. The toilet of claim 7 further comprising a cover member attached to the upper portion to cover and conceal the valve from view, the cover member being snap attached to the upper portion to enable the cover member to be removed to gain access to the valve.

9. The toilet of claim 1 further comprising:

a toilet upper portion which includes the bowl;

a housing upon which the upper portion is mounted;

a closure member mounted to the upper portion and movable between positions opening and closing the bowl discharge opening;

a flush water supply valve operatively associated with the conduit means for controlling the supply of flush water to the conduit means, the valve including a valve member movable between open and closed positions to turn on and off the supply of water to the conduit means;

a foot pedal apparatus mounted on the housing for movement in up and down directions; and a control cable having a conduit and a flexible wire within the conduit for sliding movement therein with proximal and distal ends of the wire extending from ends of the conduit, one end of the conduit being mounted to the housing and another end of the conduit being mounted to the upper portion, the proximal end of the wire being coupled to the foot pedal apparatus with the distal end of the wire operatively connected to the closure member and the flush water supply valve to move the closure member to an open position and to open the valve.

10. The toilet of claim 9 further comprising:

hand operable means associated with the closure member and the flush water supply valve for moving the closure member and for opening and closing the valve.

11. The toilet of claim 10 wherein the hand operable means includes a rotatable hand lever mounted to the upper portion and having a grip for grasping by a person to rotate the hand lever.

12. The toilet of claim 11 wherein the hand lever is operatively coupled to the closure member and to the valve to move the closure member and the valve member upon rotation of the hand lever, and wherein the distal end of the wire is coupled to the hand lever to rotate the hand lever in response to downward movement of the foot pedal apparatus whereby the foot pedal apparatus operates through the hand lever.

13. The toilet of claim 11 wherein the hand lever is coupled to the flush water supply valve by a link.

14. The toilet of claim 11 wherein the hand lever is coupled to the closure member by a gear train.

15. A toilet comprising:

an upper portion which includes an upright bowl having a bottom discharge opening;

a housing upon which the upper portion is supported;

conduit means terminating in a discharge nozzle for discharging flush water into the bowl;

a flush water supply valve operatively associated with the conduit means for controlling the supply of flush water to the conduit means, the valve including a valve member movable between open and closed positions to turn on and off the supply of water to the conduit means;

a closure member mounted to the upper portion and movable between positions opening and closing the discharge opening;

a foot pedal apparatus mounted on the housing for movement in up and down directions;

a control cable having a conduit and a flexible wire within the conduit for sliding movement therein for coupling the foot pedal apparatus with the closure member and the flush water supply valve to move the closure member to an open position and to open the valve when the foot pedal apparatus is moved down; and a rotatable hand lever mounted to the housing having a grip for grasping by a person to rotate the hand lever, the hand lever being coupled to the closure member and the flush water supply valve to move the closure member to an open position and to open the valve whereby the toilet bowl can be rinsed by activation of either the foot pedal apparatus or the hand lever.

16. The toilet of claim 15 wherein a proximal end of the wire is attached to the foot pedal apparatus and a distal end of the wire is coupled to the hand lever to rotate the hand lever in response to downward movement of the foot pedal apparatus whereby the foot pedal apparatus operates the flush water supply valve and the closure member through the hand lever.

17. The toilet of claim 15 wherein the hand lever is coupled to the flush water supply valve by a link.

18. The toilet of claim 15 wherein the hand lever is coupled to the closure member by gear sectors coupled to the hand lever and closure member.

19. The toilet of claim 15 wherein the upper portion includes a support platform integrally formed with the bowl as a single component, the flush water supply valve, hand lever and the closure member all being supported by the upper portion.

20. A toilet comprising:

an upper portion which includes an upright bowl having an upper end and a bottom discharge opening;

a housing upon which the upper portion is mounted;

conduit means terminating in a discharge nozzle for discharging flush water into the bowl;

an integral flush water valve and vacuum breaker mounted to the upper portion for controlling the flow of water through the conduit means to the bowl; and a removable cover member covering and concealing the valve and vacuum breaker, the cover member being mounted to the upper portion by snap fasteners whereby the cover member can be mounted and removed without the use of tools.

21. The toilet of claim 20 wherein the water valve and breaker and the cover member are removable from the upper portion from above whereby the valve and vacuum breaker can be serviced without removing the toilet from an installed position and requiring a toilet seal to be replaced.

* * * * *